US005161514A

United States Patent [19]

Cary

[11] Patent Number: 5,161,514

[45] Date of Patent: Nov. 10, 1992

[54] ARROW REST

[76] Inventor: John W. Cary, 2350 S. Milford Rd., Milford, Mich. 48381

[21] Appl. No.: 607,818

[22] Filed: Nov. 1, 1990

[51] Int. Cl.[5] ..... F41B 5/00

[52] U.S. Cl. ..... 124/24.1; 124/25.6; 124/44.5; 124/88

[58] Field of Search ..... 124/23.1, 25.6, 44.5, 124/88, 90, 900, 24.1, 86

[56] References Cited

U.S. PATENT DOCUMENTS

| | | | |
|---|---|---|---|
| 2,483,928 | 10/1949 | Ott | 124/88 X |
| 2,691,974 | 10/1954 | Nelson | 124/44.5 |
| 2,714,377 | 8/1955 | Mulkey | 124/25.6 X |
| 2,975,780 | 3/1961 | Fisher | 124/24.1 |
| 3,504,659 | 4/1970 | Babington | 124/24.1 X |
| 4,038,960 | 8/1977 | Ludwig | 124/24.1 X |
| 4,071,014 | 1/1978 | Trotter | 124/88 X |
| 4,287,868 | 9/1981 | Schiff | 124/24.1 X |
| 4,318,390 | 3/1982 | Trotter | 124/44.5 |
| 4,351,311 | 9/1982 | Phares | 124/44.5 |
| 4,407,261 | 10/1983 | Elliott | 124/25.6 X |
| 4,453,528 | 6/1984 | Eckert | 124/44.5 |
| 4,593,673 | 6/1986 | Kees | 124/44.5 X |
| 4,632,087 | 12/1986 | Cline | 124/44.5 |
| 4,685,439 | 8/1987 | Consentino | 124/25.6 |
| 4,703,745 | 11/1987 | Hammond | 124/44.5 |
| 4,722,318 | 2/1988 | Yankey | 124/44.5 X |
| 4,748,963 | 6/1988 | Troncoso et al. | 124/44.5 X |
| 4,796,598 | 6/1989 | Jones | 124/44.5 X |
| 4,803,971 | 2/1989 | Fletcher | 124/24.1 X |
| 4,949,699 | 8/1990 | Gerber | 124/44.5 |

OTHER PUBLICATIONS

Brochure of Whippersnapper II, Archery Show brochure Feb. 9, 1991.

*Primary Examiner*—Peter M. Cuomo

*Attorney, Agent, or Firm*—Gifford, Groh, Sprinkle, Patmore and Anderson

[57] ABSTRACT

An arrow rest assembly is disclosed for use with an archery bow movable between a cocked position and a released position to propel an arrow forwardly away from the bow. The arrow rest assembly includes an arrow rest arm which engages and supports the arrow adjacent to its forward end when the bow is in its cocked position. A detector assembly detects the movement of the bow from its cocked position towards its released position and, in response thereto, a cam assembly moves the arrow rest laterally away from the arrow to prevent interference between the arrow rest and the arrow as it is propelled forwardly by the bow.

8 Claims, 5 Drawing Sheets 22
52
54
50
36'
14
20
61
60

ARROW REST

BACKGROUND OF THE INVENTION

I. Field of the Invention

The present invention relates generally to archery devices and, more particularly, to an improved arrow rest for an archery bow.

II. Description of the Prior Art

In the sport of archery, the archery bow is movable between a cocked position and a released position. In its cocked position, the bowstring is drawn rearwardly away from the bow and a slotted rear end of an arrow is positioned around the bowstring. Upon release of the bowstring, the bowstring and bow move towards their released position and, in doing so, propel the arrow forwardly of the bow.

In the previously known archery bows, an arrow rest is secured to the bow which supports the front end of the arrow when the bow is in its cocked position. Once the bowstring is released, the bowstring propels the arrow over the arrow rest and forwardly of the bow in the well known manner.

One disadvantage of these previously known arrow rests, however, is that the arrow rests impart a small lateral movement to the arrow as the bowstring is released from its cocked position. This is true even for experienced archers since the forces created upon the release of the bowstring from its cocked position cause even experienced archers to jiggle or move the bow somewhat when making a shot. Since such jiggling imparts a lateral force to the arrow during its release from the bow, it deflects the arrow and adversely affects the accuracy of the shot.

SUMMARY OF THE PRESENT INVENTION

The present invention provides an arrow rest assembly for an archery bow which overcomes all of the above mentioned disadvantages of the previously known arrow rests.

In brief, the arrow rest assembly of the present invention comprises an arrow rest arm which is adapted to engage and support the arrow adjacent to its forward end when the bow is in its cocked position. The assembly further includes means for detecting movement of the bow from its cocked position towards its released position and means responsive to the detector means for moving the arrow rest arm laterally away from the arrow upon release of the bowstring and thus away from the arrow as the arrow is shot. Consequently, since the arrow rest arm is moved laterally away from the arrow upon release of the bowstring and as the arrow is being shot from the bow, slight movement or jiggling of the bow during release of the bowstring is not imparted to, and thus does not deflect, the arrow.

In the preferred embodiment of the invention, the arrow rest assembly is adapted for use with a compound bow having a cable guard which extends rearwardly from the bow and a slide which is slidably mounted to the cable guard. The cables from the compound bow engage one side of the slide so that the cable guard slide moves from a retracted position when the bow is in its cocked position to a forward position when the bow is in its released position.

A cam assembly is then mounted to or contained within the cable guard. The cam assembly includes an arrow rest arm which engages and supports the arrow. A pin on the cam assembly then cooperates with the slide on the cable guard to pivot the arrow rest arm laterally away from the arrow as the cable guard moves from its retracted to its forward position and thus during the shot.

In one embodiment of the invention, the cam assembly pin abuts against the forward end of the cable guard slide and is longitudinally displaced along the cable guard slide as the bow is released from its cocked position. This lateral displacement of the pin is transmitted to a cam surface which laterally pivots the arrow rest arm member away from the arrow in the above described fashion.

In a second embodiment of the invention, both the cam pin and the arrow rest member are secured to a rod which is pivotal between two positions. The cam pin is received within a helical am slot formed in the cable guard slide so that, upon release of the bow from its cocked to its released position, the cam pin rotatably pivots the rod with the attached arrow rest arm. The pivotal movement of the arrow rest arm moves it laterally away from the arrow during the shot

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
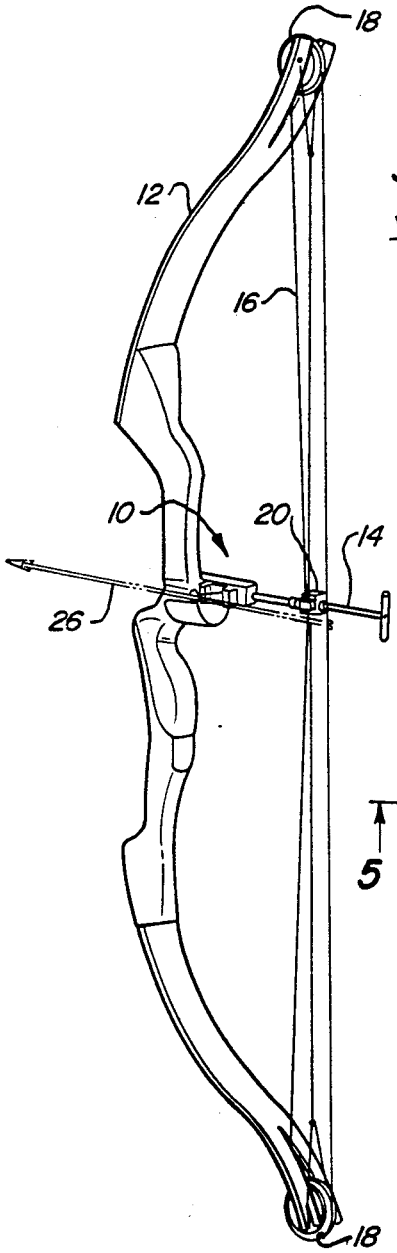
FIG. 1 is a side view illustrating a preferred embodiment of the arrow rest assembly of the present invention mounted to the bow.
Figure 2:
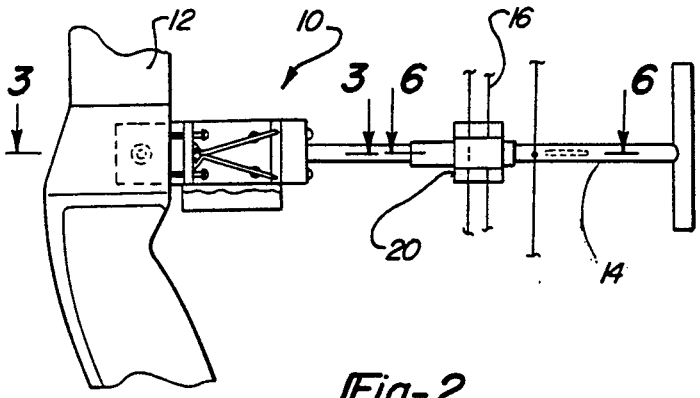
FIG. 2 is a fragmentary side view illustrating the preferred embodiment of the invention.

With reference first to FIGS. 1 and 2, a first preferred embodiment of the arrow rest assembly 10 is thereshown mounted to an archery bow 12. The archery bow 12 illustrated in FIG. 1 is a compound bow having a cable guard 14 extending rearwardly from a midportion of the bow 12. In the well known fashion, the bow 12 includes tension cables 16 which extend around pulleys 18 at the opposite ends of the bow 12. These tension cables 16 engage one side of a cable slide 20 which is slidably mounted to the cable guard 14.

Figures 7, 8, 9, 10:
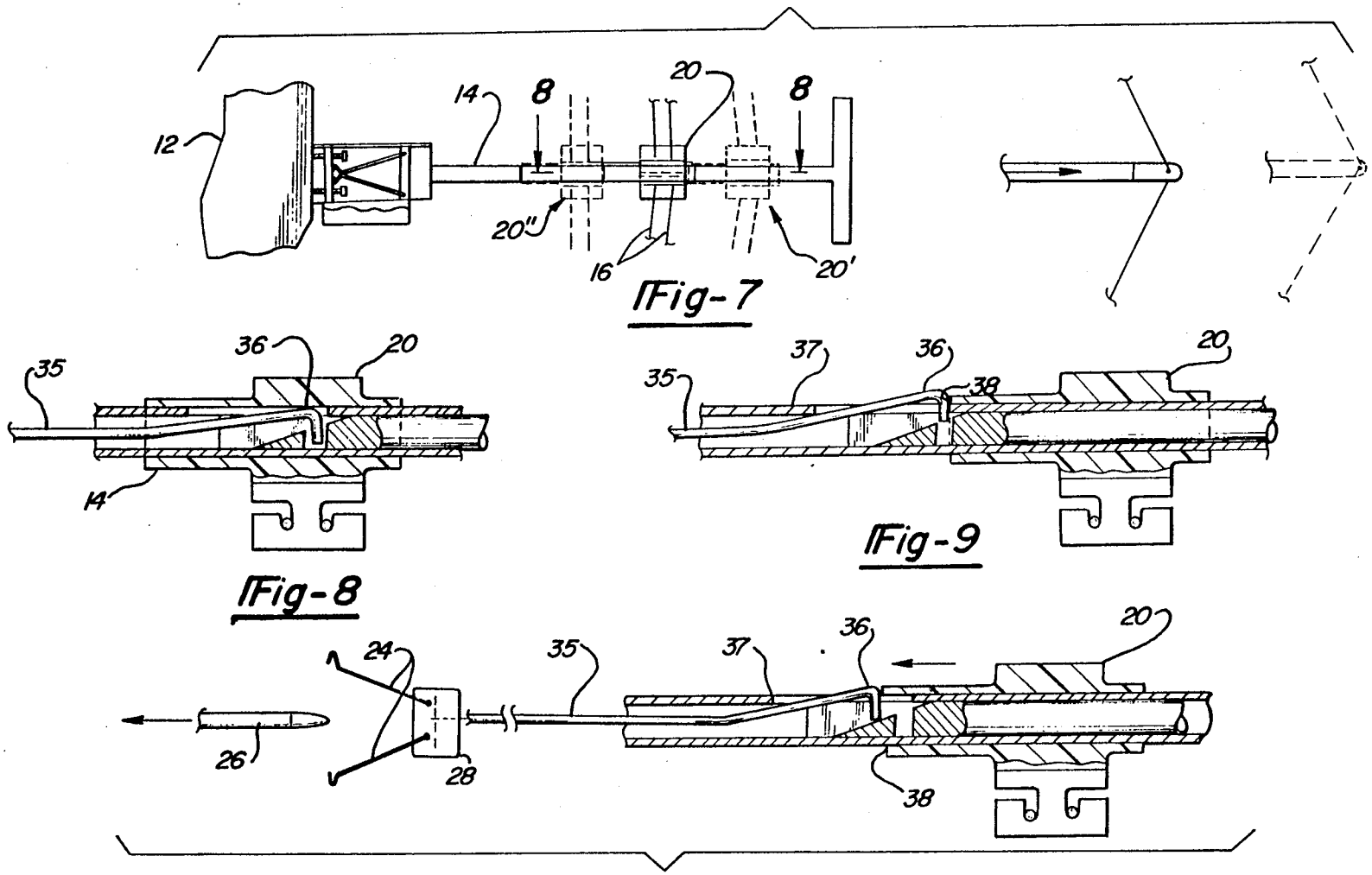
FIG. 7 is a diagrammatic exploded view illustrating the operation of the arrow rest assembly of the present invention.
FIG. 8 is a sectional view taken substantially along line 8—8 and enlarged for clarity.
FIG. 9 is a view similar to FIG. 8, but showing the cable slide in the bow cocked position.
FIG. 10 is an exploded diagrammatic view illustrating the operation of the preferred embodiment of the present invention.
Figure 12:
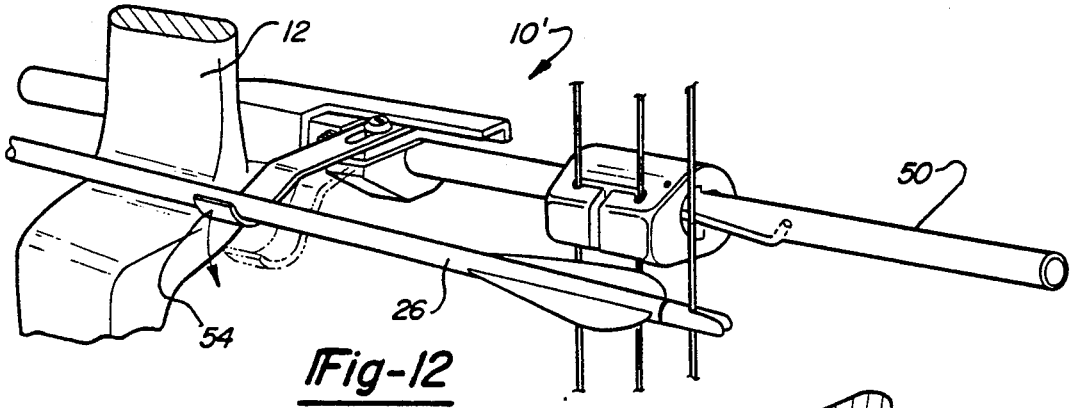
FIG. 12 is an elevational view illustrating a second preferred embodiment of the present invention.
Figure 13:
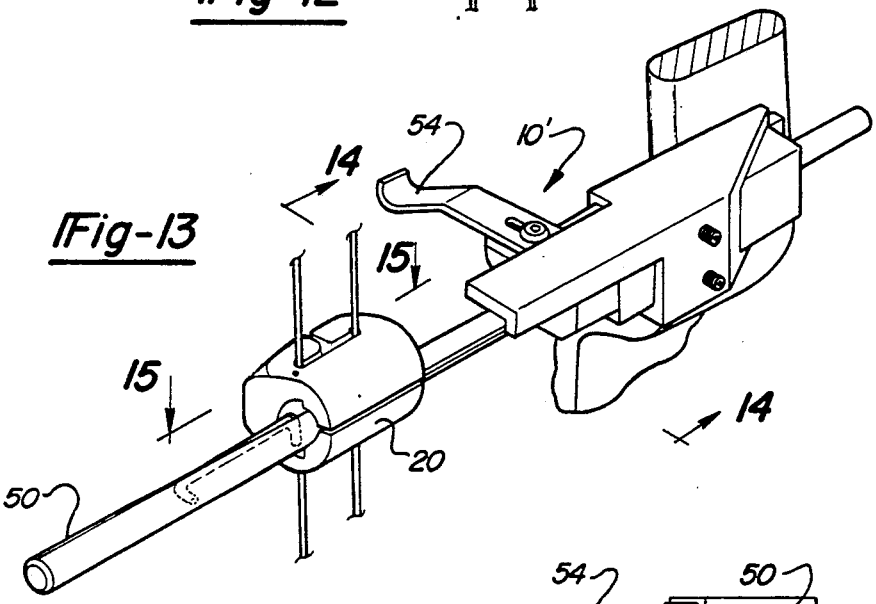
FIG. 13 is an exploded fragmentary perspective view of the second preferred embodiment of the present invention.

The cable guard 14, together with the cable slide 20 displaces the tension cables 16 laterally away from the center of the bow 12 and allows the archer to make his or her shot. Furthermore, as best shown in FIG. 7, as the bow 12 is moved from its cocked position, illustrated at 20' in FIG. 7, to its released position, illustrated at 20" in FIG. 2, the cable slide 20 moves from a rear position 20' to a forward position 20".

Figure 3:
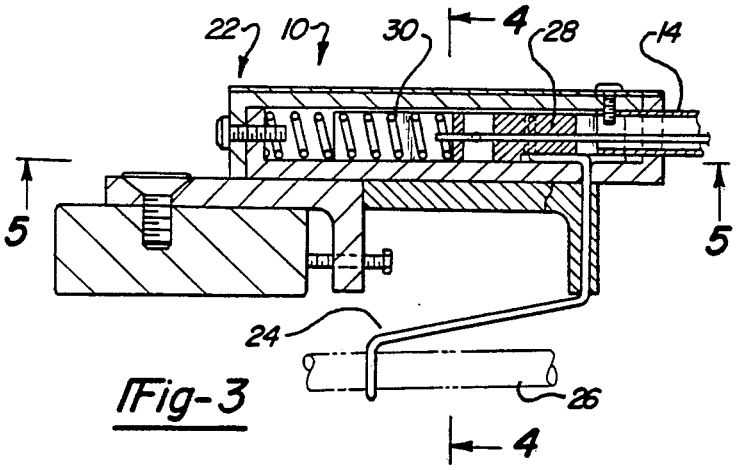
FIG. 3 is a sectional view taken substantially along arrow 3 in FIG. 2.
Figures 5, 6, 11:
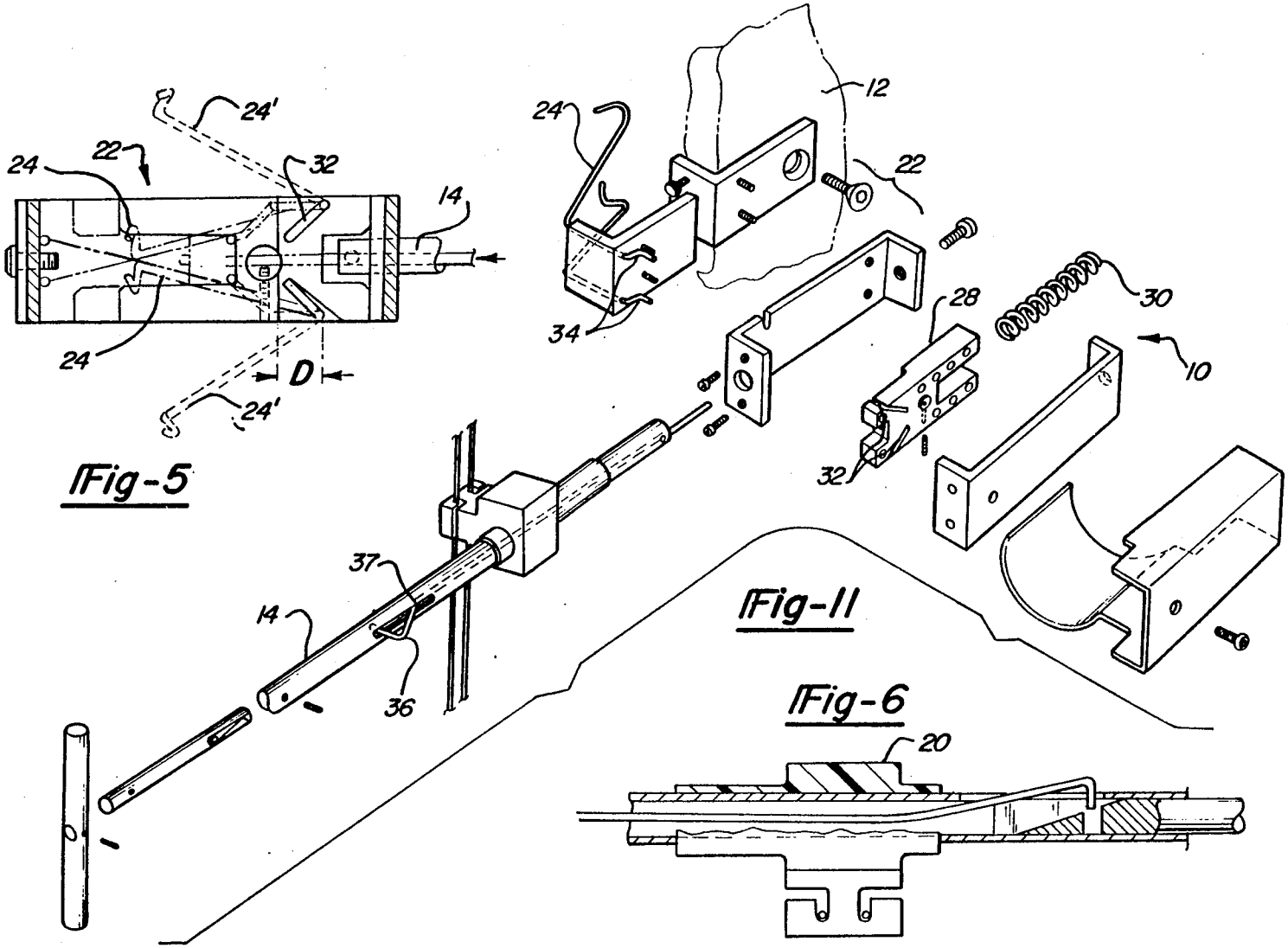
FIG. 5 is a plan view illustrating a portion of the preferred embodiment of the present invention.
FIG. 6 is a sectional view taken substantially along line 6—6 in FIG. 2 and enlarged for clarity.
FIG. 11 is an exploded view of the preferred embodiment of the present invention.

With reference now to FIGS. 3, 5 and 11, the arrow rest assembly 10 of the present invention is thereshown in greater detail and comprises a mount 22 which is secured to the midpoint of the bow 12 so that the cable guard 14 extends rearwardly from the mount 22. As best shown in FIG. 3, the cable guard 14 is preferably tubular in construction.

Figure 4:
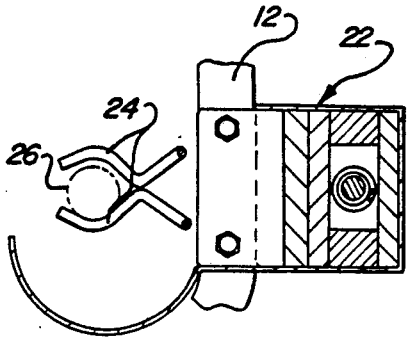
FIG. 4 is a sectional view taken substantially along line 4—4 in FIG. 3.

As best shown in FIGS. 4 and 5, at least one, and preferably two, arrow rest arms 24 are pivotally secured to the mount 22 so that the arms 24 are pivotal between a first position illustrated in solid line in FIG. 5, and a second position illustrated in phantom line in FIG. 5. In their first position, the arms 24 are adapted to engage and support a forward end of an arrow 26 (FIG. 4) when the bow is in its cocked position. Conversely, in its second position as shown at 24' in FIG. 5, the arms 24 move laterally away from the arrow 26.

Referring now to FIGS. 3, 5 and 11, a cam slide 28 is contained within the mount 22 and is movable between a retracted position, illustrated in solid line in FIG. 5, and a forward position, illustrated in phantom line in FIG. 5. A compression spring 30 urges the cam slide 28 towards its retracted position.

The cam slide 28 includes two cam or ramp surfaces 32 (FIGS. 5 and 11) which cooperate with two end portions 34 of the arrow rest arms 24. When the cam slide 28 is in its retracted position (solid line in FIG. 5) the arrow rest arms 24 engage and support the arrow 26 in the previously described fashion. Conversely, as the cam slide 28 moves to its forward position as shown in phantom line in FIG. 5, the cam surfaces 32 pivot the end portions 34, together with the arrow rest arms 24, away from the arrow 26 to the position to enable the arrow 26 to be propelled forwardly of the bow without further contacting the arrow rest arms 24.

With reference now to FIGS. 8–10, an elongated wire 35 having an outwardly extending resilient pin 36 at its rear end is attached at its front end to the cam slide 28. In doing so, the pin 36 protrudes outwardly through a slot 37 in the cable guard 14. When the bow is in its cocked position and the cable slide 20 moved to its rearwardmost position (20 in FIG. 7), the pin 36 abuts against a front end 38 of the slide 20 as shown in FIG. 9. Consequently, upon release of the bow from its cocked position, the arrow slide 20 moves forwardly along the cable guard 14 and pushes the pin 36 from its retracted position, illustrated in FIG. 9, to its forward position, illustrated in FIG. 10. In doing so, the pin 36 moves the cam slide 28 forwardly which pivots the arrow rest arms 24 laterally away from the arrow 26 as shown at 24' in FIG. 4 in the previously described fashion. Furthermore, the arrow 26 is shot from the bow at such a high speed that the arrow 26 has exited the bow before the arrow rest arms 24 can return to their arrow supporting position.

The pin 36 is flexible so that it can retract within the interior of the cable guard 14 as shown in FIG. 8. Furthermore, as the cable slide 20 passes over the slot 37 as the bowstring is released, the coaction between the pin 36 and the front end of the slot 37 forces the pin 36 inwardly into the interior of the cable guard 14 as best shown in FIG. 8.

After the slide 20 passes completely across the slot 37, the compression spring 30 returns the cam slide 28 to its rear position so that the pin 36 again protrudes outwardly through the slot 37 in the cable guard 14, but behind the cable guard slide 20. When this occurs, the arrow rest arms 24 move to their closed position as illustrated at 24 in FIG. 5 and are ready to receive and support a subsequent arrow for the next shot. Thereafter, when the bow is moved to its cocked position, the cable slide 20 merely forces or compresses the pin 36 into the interior of the cable slide 14 without moving the arms 24 as in FIG. 8 until the bow is fully cocked. When the bow is fully cocked, the pin 36 again abuts against the front 38 of the slide 20 (FIG. 9) wherein the above process is repeated. Consequently, since the pin 36 merely retracts within the interior of the cable guard 14 when the bow is cocked, the arm rest members 24 engage and support the arrow 26 during the entire bow cocking operation.

A primary advantage of the arrow rest assembly of the present invention is that the arm rest members engage and support the forward end of the bow not only when the bow is cocked, but also during the cocking operation. Upon release of the bowstring, however, the cable guard 20, through the cam slide 28, pivots the arrow rest arms 24 laterally away from the arrow 26 as the arrow 26 is propelled forwardly of the bow. Consequently, slight movement or jiggling of the bow 12 by the archer will not be imparted to or deflect the arrow 26 as with the previously known arrow rests.

With reference now to FIGS. 12–20, a second preferred embodiment 10' of the arrow rest assembly of the present invention is thereshown in which the cable guard 14 comprises a rod 50. This rod 50 is pivotal between a first position, illustrated in solid line in FIGS. 12 and 14, and a second position, illustrated in phantom line in FIGS. 12 and 14. A torsion spring 52 (FIG. 20) urges the rod 50 towards its first pivotal position.

A single arrow rest arm 54 is secured to and extends laterally outwardly from the rod 50 so that the arm 54 pivots in unison with the rod 50. This arm 54 includes a generally U-shaped arrow supporting portion which is adapted to support and engage a forward end of the arrow 26 when the bow is in its cocked position.

Figure 14:
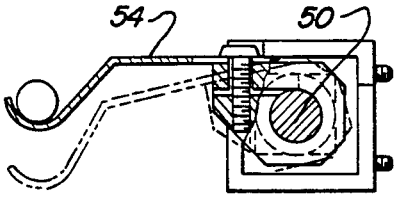
FIG. 14 is a sectional view taken substantially along line 14—14 in FIG. 13.
Figure 15:
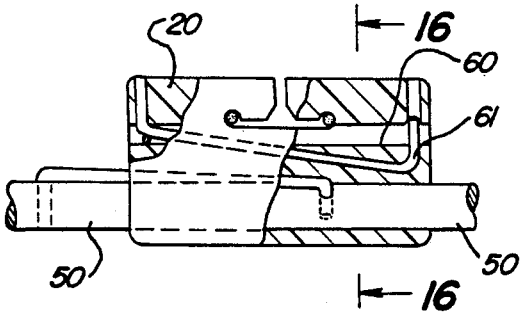
FIG. 15 is a sectional view of a portion of the second preferred embodiment of the present invention.
Figure 16:
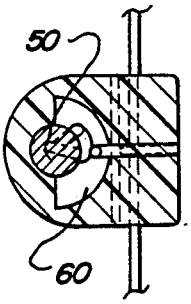
FIG. 16 is a sectional view taken substantially along line 16—16 in FIG. 15.

An elongated pin 36' having an axis angled with respect to the axis of the rod 50, is secured to the rearward end of the rod 50. The pin 36 registers with a slot 60 having an actuator 61 formed in the cable slide 20. Thus, when the bow is in its cocked position, the pin 36 registers with the slot 60 at the front end 38 of the slide 20. Upon release of the bowstring and the subsequent forward movement of the cable slide 20 along the cable guard 14, the coaction between the actuator in the slot 60 and pin 36, best shown in FIG. 19, rotatably pivots the pin 36, with the attached rod 50, from the first position of the rod shown in solid line in FIG. 14 to the second pivotal position of the rod shown in phantom line in FIG. 14. In doing so, the rod 50 pivots the arrow rest arm 54 laterally downwardly away from the arrow 26 as best shown in FIG. 14.

Figures 17, 18, 19, 20:
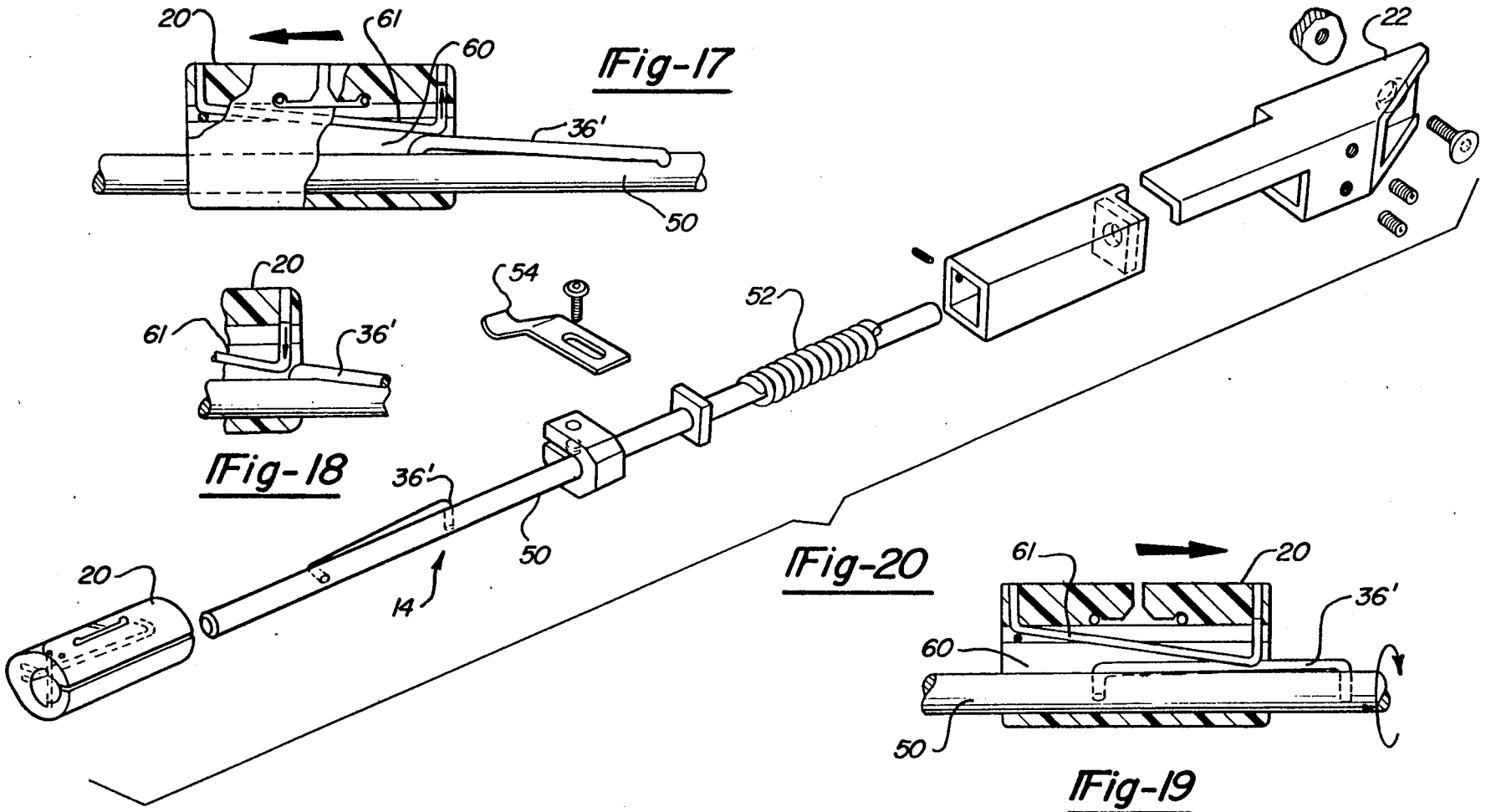
FIG. 17 is a view similar to FIG. 15 but illustrating the cable slide in a different operative position.
FIG. 18 is a fragmentary sectional view similar to FIG. 17 but illustrating the cable slide in a different position.
FIG. 19 is a view similar to FIG. 17, but illustrating the slide in a different operative position.
FIG. 20 is an exploded view illustrating the preferred embodiment of the present invention.

The actuator 61 is retractable within the interior of the cable slide 20 as best shown in FIGS. 17 and 18. Thus, following the shot, the pin 36' is positioned behind the slide 20 as shown in FIG. 18 and in which the rod 50 has been pivoted to its first position. Thereafter, as the bow is cocked, the slide 20 compresses the actuator 61 into the interior of the cable guard 14, as shown in FIG. 17, so that the rod 50 with its attached arrow rest arm 54 remains in its first arrow supporting position during the entire bow cocking operation.

From the foregoing, it can be seen that the present invention provides a simple and yet totally effective arrow rest assembly for use with an archery bow.

Having described my invention, however, many modification thereto will become apparent to those skilled in the art to which it pertains without deviation from the spirit of the invention as defined by the scope of the appended claims.

I claim:

1. For use with an archery bow and an arrow, said bow being movable between a cocked position and a released position to propel the arrow forwardly away from the bow, an arrow rest assembly comprising:

at least one arrow rest arm adapted to engage and support the arrow adjacent its forward end when said bow is in said cocked position, means movable from a first cocked position towards a second released position in response to movement of said bow from said cocked position toward said released position, and means responsive to movement of said movable means from said first cocked position toward said second released position for pivoting said at least one arrow rest arm laterally away from said arrow, wherein said bow is a compound bow having a cable guard extending rearwardly from a midpoint of the bow, said movable means comprising a cable slide, said cable slide being slidably mounted to said cable guard, said compound bow having a cable extending between the ends of the bow, said cable engaging said cable slide so that said cable slide moves between said first cocked position and said second released position in unison with said cable.

2. The invention as defined in claim 1 wherein said pivoting means comprises a cam member movable between a retracted position and a forward position, said cam member having a cam surface which cooperates with said at least one arrow rest arm to move said at least one arrow rest laterally away from said arrow as said cam member moves from said retracted position toward said forward position, and means for urging said cam member toward said retracted position.

3. The invention as defined in claim 2 wherein a portion of said cam member is contained within said cable guard.

4. The invention as defined in claim 2 wherein said cam member comprises a pin which abuts against a forward end of said cable slide when said bow is in said cocked position.

5. The invention as defined in claim 4 wherein said pin is movable between an extended position in which said pin protrudes outwardly from said cable guard and a retracted position in which said pin retracts into said cable guard and permits said cable slide to move over said pin, and means for urging said pin toward said extended position.

6. The invention as defined in claim 1 wherein said at least one arrow rest comprises two opposed arms which engage and support opposed sides of the arrow when said bow is in the cocked position.

7. The invention as defined in claim 1 wherein said pivoting means comprises a rod pivotal between a first and second position, said at least one arrow rest arm extending radially outwardly from said rod, and means responsive to movement of said cable slide from said first cocked position towards said second released position for pivoting said rod from said first position to said second position.

8. The invention as defined in claim 7 wherein said pivoting means comprises a radially outward pin attached to said rod, a cam slot having an actuator formed in said cable slide, said pin and said actuator cooperating to pivot said rod as said pin moves through said cam slot.

* * * * *